US005933113A

United States Patent [19]

Newberg et al.

[11] Patent Number: 5,933,113

[45] Date of Patent: Aug. 3, 1999

[54] SIMULTANEOUS MULTIBEAM AND FREQUENCY ACTIVE PHOTONIC ARRAY RADAR APPARATUS

[75] Inventors: Irwin L. Newberg, Northridge; Kapriel V. Krikorian, Agoura; J. J. Lee, Irvine; Robert A. Rosen, Aguora Hills; Gregory L. Tangonan, Oxnard, all of Calif.

[73] Assignee: Raytheon Company, Lexington, Mass.

[21] Appl. No.: 08/711,428

[22] Filed: Sep. 5, 1996

[51] Int. Cl.[6] ..... H01Q 03/22

[52] U.S. Cl. ..... 342/375; 342/368

[58] Field of Search ..... 342/368, 372; 356/5.01; 359/237

[56] References Cited

U.S. PATENT DOCUMENTS 3,090,928 5/1963 Welty ..... 342/375

5,367,305 11/1994 Völker et al. ..... 342/368

5,374,935 12/1994 Forrest ..... 342/368

*Primary Examiner*—Mark Hellner

*Attorney, Agent, or Firm*—Leonard A. Alkov; Glenn H. Lenzen, Jr.

[57] ABSTRACT

Fiber optic delay lines in the form of a modified corporate feed having progressive phase delays and a corporate feed having equal phase delays are used to couple RF modulated light signals to detecting, mixing, amplifying and radiating devices of an active array radar. Different RF signals may be sent over the same fiber delay lines using different light colors (or wavelengths) so that the RF modulated signals in the fiber delay lines do not interact with each other. The RF signals can be put on and taken out of the fiber lines using wavelength division multiplexers, for example. This provides an array with a single optical manifold that allows simultaneous full aperture operation at multiple frequencies and/or beams over a wide operating frequency range.

9 Claims, 3 Drawing Sheets

10b
Transmit/Receive T/R1
60
37
52
53
54
55
56
I/Q
MOD
36
51
SW
35
BPF
34
33
33
I/Q1
Rec Video Optical Manifold
62
61
On Array
Remote
I/Q2 I/Q1 I/Qn
R2
Rn
T/R2
T/Rn
60
60
d2 d0 I/Q2
dn d0 I/Qn
θ
f0
70
PD
PD
PD
d0
d0
d0
v1
v2
vn
71
72
Video Summing
73
I or Q
A/D
74
Remote I or Q Video 1
40
Progressive Delays, (1 to n)
41
42
d1
d2
dn
d0
d0
d0
Delays All Equal
Transmit Optical Manifold
Tuning Frequency
ft
EMt
23
23
EMs
fs
Second Frequency
21
SSLS
λ1
20
Remote Transmit Signals 1

SIMULTANEOUS MULTIBEAM AND FREQUENCY ACTIVE PHOTONIC ARRAY RADAR APPARATUS

BACKGROUND

The present invention relates generally to active array systems, and more particularly, to active array systems that process simultaneous multiple beams/frequencies and can operate over a very wide frequency range and thus overcome the limitations of conventional systems.

Conventional phased array systems have limited operating frequency range, have a large weight and size, and are generally restricted to single beam and narrow frequency operation range. In order to steer multiple beams at different frequencies, conventional phased array systems would need to use multiple manifolds, one for each independent beam and or frequency.

The present invention replaces and improves upon a technique for generating a plurality of signals for RF transmission having variable phase differences described in U.S. Pat. No. 3,090,928, assigned to the assignee of the present invention, and also described in a recent MTT paper entitled "Frequency Controlled Antenna Beam Steering", published in the 1994 IEEE MTT-S Digest, CH33694/94/0000 1549501,00.

The basic concept disclosed in that patent and paper is to use a prior frequency-scanned radar beam steering transmission technique that used a series delay line "traveling wave" feed to provide progressive phase delays needed to steer (scan) beams of an antenna array. Thus, the typical phase shifters needed to steer a phased array are eliminated. That prior technique, implemented before the above-referenced patent, had the disadvantage of having the radiated frequency directly dependent on the selected beam pointing direction.

The technique described in that patent uses a dual RF delay series traveling wave feed where the radiated frequency $\omega_1$ is generated by mixing a frequency ($\omega$-$\omega_1$) with a tuning (steering) frequency ($\omega$). The tuning frequency $\omega$ is sent down one of the delay lines and tapped off to each radiator from equally spaced ("time") delay taps. Another frequency that is the combination of $\omega$ and $\omega_1$, i.e., ($\omega$-$\omega_1$), is sent down the other (dual) delay line from the opposite or other side of a line feed. RF mixing of the signals on each delay line is used to generate the radiated frequency.

The fact that the tuning frequency ($\omega$) is present in both delay lines, that is, separately in one delay line and as a combination with the radiated frequency $\omega_1$ in the other delay line, provides the desired result after mixing of an operating radiated frequency ($\omega_1$) that does not change as the tuning frequency ($\omega$) is changed (tuned) to steer the array beam. The tuning frequency is canceled out by virtue of mixing the two frequencies at each radiator of the phased array and filtering is used to obtain only the $\omega_1$ difference frequency as the radiated signal.

The correct progressive phase is generated with a modulo $2\pi$ residue, wherein the modulo $2\pi$ residue adds or subtracts multiples of $2\pi$ or 360° values to a relative phase between radiators, and thus has no effect on beam steering. Thus, the operating frequency that is generated and sent to each radiator after mixing and filtering has the correct relative phase to steer the antenna array. This same concept is also described in the referenced paper.

Accordingly, it is an objective of the present invention to provide for active array systems that process both transmitting and reception at simultaneous multiple beams/frequencies over a wide frequency range, and overcome limitations of conventional phased array systems and improve upon the teachings of the above-referenced patent.

SUMMARY OF THE INVENTION

To meet the above and other objectives, the present invention provides for radar apparatus having an RF modulated light source for providing modulated light output signals at a first frequency, and at a second frequency that is equal to the first frequency plus a second frequency. Optical splitters are used to direct the modulated light output signals along a respective plurality of light paths, and an optical manifold couples the modulated light output signals along a respective plurality of optical paths. A plurality of photodetectors are used to convert the modulated light output signals at the first and second frequencies into modulated electrical signals.

A plurality of mixers are provided for mixing the modulated electrical signals at the first and second frequencies, and a plurality of filters output difference signals that are the difference between the first and second frequencies. A plurality of amplifiers amplify the difference signals, and a plurality of radiators radiate the difference signals. The optical manifold provides a first plurality of light paths having progressive phase delays ($d_1$-$d_n$) for light at the first frequency and a second plurality of light paths having substantially equal phase delays ($d_0$) for light at the second frequency.

The light source may also provide a plurality of RF modulated light signals at a plurality of light wavelengths, and wavelength division multiplexers may be used to multiplex and demultiplexing the signals. Summing devices are provided for combining difference signals at the plurality of wavelengths and for coupling them to respective the radiators.

The radar apparatus of claim 1 may further comprise a plurality of switches, circulators, receive mixers and video processing circuitry that are used to process the difference signals and signals received by the radiators and output video signals that are indicative of targets seen by the radar apparatus. The difference signals applied to the receive mixers have a phase that is the conjugate of the transmit phase.

Thus, in the present radar apparatus, conventional electronic RF delay lines are replaced by fiber optic delay lines, which provide several useful and important features including an extremely wide operating frequency range, and the ability to process different RF signals using different light colors (or wavelengths). Consequently, the RF signal that is modulated on the light carrier in the fiber does not interact in any way with RF signal on any other color carrier. The RF signal may be put on and taken out of the fiber delay lines using optical filtering, wavelength division multiplexing, of different light carriers. This provides an array with a single manifold that provides simultaneous full aperture operation for both transmit and receive with multiple frequencies and/or beams over a wide operating frequency range. Although a signal manifold is used, typically the inputs and outputs of the manifold (optoelectronic and electronic components) may need to be repeated or duplicated for each beam and/or frequency. Also, two dimensional beam steering using these techniques is provided.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
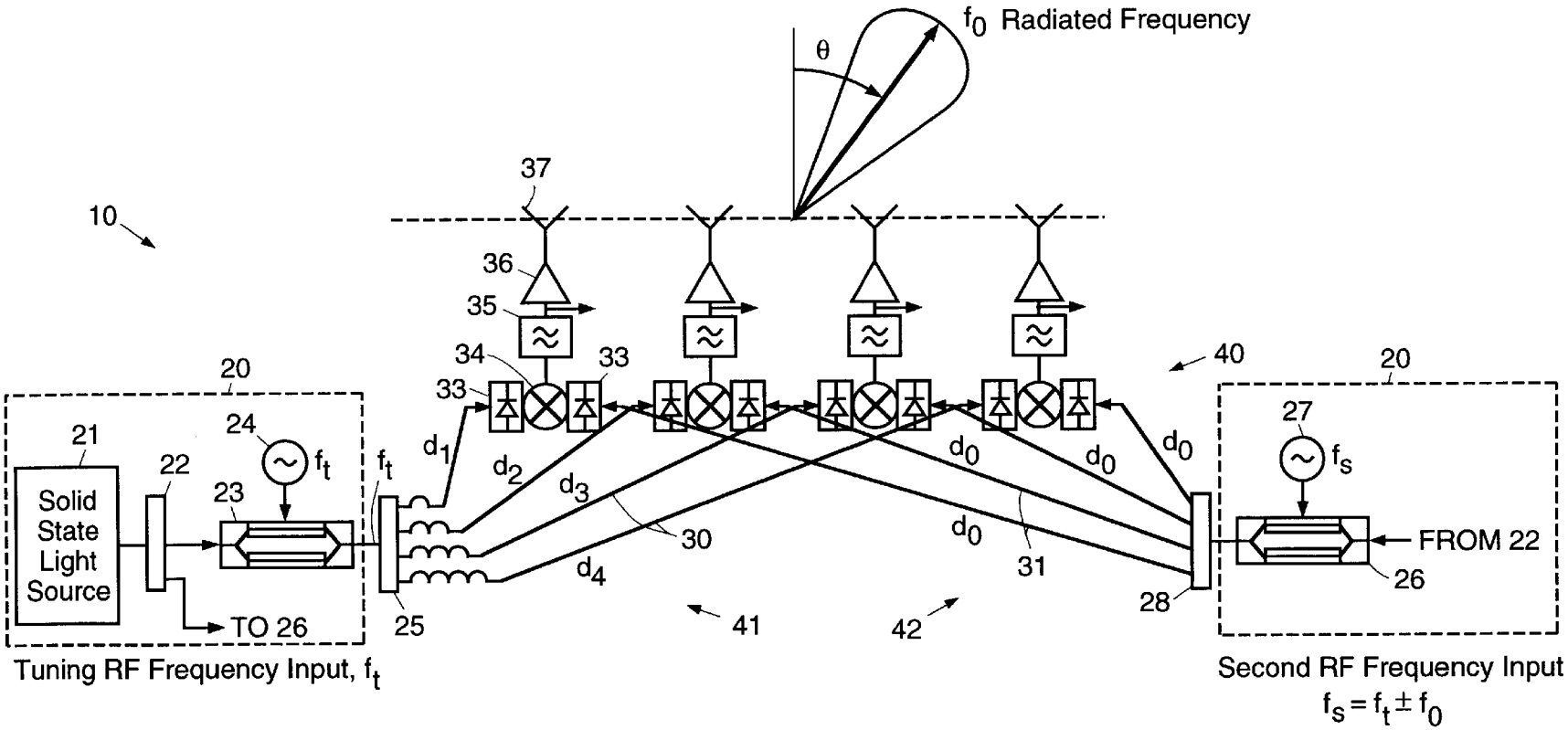
FIG. 1 shows a phase steered subarray in accordance with the principles of the present invention used for transmission.

Referring to FIG. 1, it shows a simplified diagram of a modified corporate all optical feed manifold 40 in accordance with the principles of the present invention and illustrates how a transmit function may be implemented in an active array 10 in accordance with the present invention. More specifically, FIG. 1 shows a phase steered array 10 or subarray 10 in accordance with the principles of the present invention used for transmission. The active array 10 comprises an RF modulated light source 20 that includes a light source 21, such as a solid state light source 21, which is coupled by way of an optical splitter 22 to first and second external modulators 23, 26. Each external modulator 23, 26 is coupled to a separate electrical frequency source 24, 27, such as are provided by RF oscillators 24, 27. The oscillator 24 for the first external modulator 23 provides a tuning frequency ($f_t$), while the oscillator 27 for the second external modulator 26 provides a second frequency ($f_s$) or signal frequency.

Outputs of the respective external modulators 23, 26 are coupled to inputs of the feed manifold 40 which comprises a dual feed 40 having separate feeds 41, 42. The feed manifold 40 or dual feed 40 comprises first and second optical splitters 25, 28 that are coupled to a plurality of optical fibers 30, 31. The first line feed 41 is a combination of delay lines and provides a plurality of predetermined delays ($d_1$-$d_4$) while the second feed 42 is a corporate feed that provides equal delays ($d_0$). It is to be noted that in the drawing figures, the lengths of each equal delay $d_0$ are not depicted as equal, although in practice they are equal. Corresponding outputs of the first and second feeds 41, 42 are respectively coupled by way of photodiode detectors 33 to a plurality of mixers 34. Outputs of the plurality of mixers 34 are coupled by way of a plurality of filters 35 and amplifiers 36 to a plurality of antenna elements 37 or radiators 37 that radiate a predetermined frequency that is steered in a predetermined direction.

In operation, a tuning frequency $f_t$ travels in one direction in a progressive delay line feed 41 and a second frequency $f_s$ travels in a corporate delay line feed 42. The second frequency is the sum of both the tuning (steering) frequency ($f_t$) and the desired radiated frequency $f_0$ (or signal containing the "information"). Both the tuning frequency and second or signal frequency are respectively supplied by the delay line feeds 41, 42 at each radiator location, and mixed and filtered by the mixer 34 and filter 35 so that the difference frequency output of the mixer 35 that is supplied to the radiator 37 is only the desired radiated frequency $f_0$; all other frequencies are filtered out. Thus, the array 10 can be steered (pointed) independently using the tuning frequency and always radiate at the same frequency, $f_0$, that contains the "information" and is the desired radiated signal.

The relative delays used for the delay line feed 41 (tuning frequency) is designed to achieve a progressive set of phase delays on the mixer difference frequency at each radiator 37 so that the array 10 steers the beam to the desired pointing direction by changing the tuning frequency. Thus the output of the mixer 34, in a sense, provides a phase shifter function for each radiator 37 and no phase shifter for array steering is needed. The selection of the relative delay (or delay, relative to the physical spacing of the radiators 37) between each output in the feed 41 determines the frequency tuning range required to steer the array 10 to the pointing angle extremes.

FIG. 1 shows a phase steered array 10 or subarray 10 in accordance with the principles of the present invention that is implemented using optoelectronic devices. The word optoelectronics is used to indicate that a combination of optical components and electronics are employed. This is to distinguish it over photonics which covers anything associated with light, and fiber optics which covers items related to optical fibers and components associated with the fibers.

In FIG. 1, the electronic components and manifolds 41, 42 use fiber optic components combined with electronic components, achieving an optoelectronic transmit array with radiated frequency, $f_0$. In the above and all the following, the symbol f instead of ω for frequency is used to distinguish the present invention from the prior art, where ω was used. Also the tuning frequency is the frequency that steers or points the array 10. The RF tuning frequency $f_t$ and second frequency $f_s$ are modulated on light using a solid state laser source 21 and external modulators 23, 26. The laser source 21 is one type of component that may be used to provide an RF modulated light signal.

In an important improvement of the present invention, the feed 40 is shown as a modified corporate feed 41, meant herein to describe a type of manifold 40 different from the prior art traveling wave feed discussed in the Background section. The feed 40 uses optical fibers 30, 31 to carry the tuning and second frequencies to the photodiode detectors 33 at each radiator 37. The detectors 33 demodulate the RF energy from the light and provide RF output signals to the mixer 34. The output of the mixer 35 is filtered and then goes to the radiator through a high power amplifier.

The modified corporate feed 41 includes a set of progressive delays 30 (each a multiple of a basic delay length) that carry the tuning frequency and provide a set of progressive phases at each radiator that steer the beam. The second frequency (that contains the radiated and tuning frequencies) is sent over a true corporate feed 42 provided by the optical splitter 28 and equal length delay lines 31), i.e., one with all equal path lengths (or delays) such that all second frequency mixer inputs have equal relative phases. This modified corporate feed 41 for tuning and true corporate feed 42 for the second frequency are an improvement over the dual delay traveling feed of the prior art.

The use of an optoelectronic beamforming manifold 40 that has the second frequency sent over an equal line length (delay) corporate feed 42 and the tuning frequency sent over a modified corporate feed 41 with progressive delta delays, achieves the same small beam broadening, or beam squint, that can be obtained with current phased arrays using phase shifters in a conventional phase array corporate feed. This feed is different from the series dual delay traveling wave feed where much larger beam broadening will be generated; the series dual delay line traveling wave feed implementation is the one described in the above-referenced patent. This provides for a major improvement over a conventional series dual delay traveling wave feed. There is also no constraint (as in the dual traveling wave delay line feed) on the length of the progressive delays and their relationship to the amount of beam squint caused by the instantaneous bandwidth of the signal frequency. This allows the tuning frequency range to be independently selected for optimum design.

Figure 2:
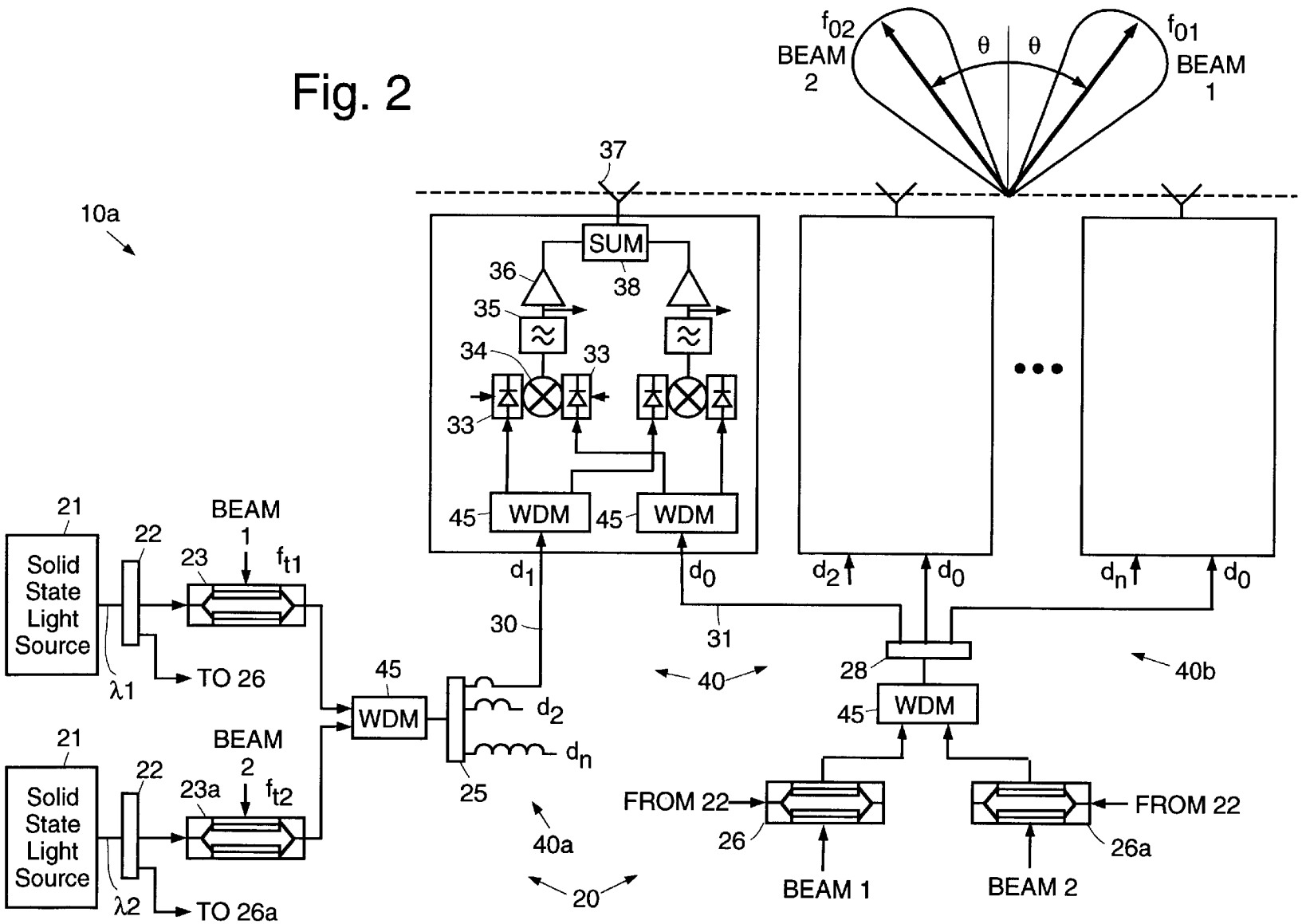
FIG. 2 shows a phase steered subarray in accordance with the principles of the present invention used for transmission of two beams simultaneously.

Once the basic transmit manifold 40 shown in FIG. 1 is in place, then as shown in FIG. 2, a second solid state light source 21, external modulators 23*a*, 26*a* and photodiode detectors 33, plus electronics, can use the same optoelectronic manifold 40 to provide a separate set of beams and/or radiated frequencies that can be generated simultaneously. One way to achieve this is by using wavelength division multiplexing (WDM) devices 45 to add and separate light wavelengths. Lambda ($\lambda$) is used to designate the light wavelength, where $\lambda$ is typically in the 1300 or 1500 nanometer wavelength range. In FIG. 2, $\lambda_1$ its used to designate light at one wavelength or color whereas $\lambda_2$ designates light at another wavelength. For two beams, $\lambda_1$ may be used for one beam and $\lambda_2$ may be used for the other beam (and so forth for additional beams).

FIG. 2 shows a transmit implementation using two beams that share a common manifold 40. The light sources 21 and modulators 23, 26 are located remote from the array 10*a*. The array 10*a* may be a subarray 10*a* of a larger antenna array 10*a*. More beams and/or radiated frequencies may be added in a similar manner. Also, good design can help to minimize hardware complexity for multiple beams and thus other implementations are possible. The WDM devices 45 are optical filters, that are typically gratings on the fibers 30, 31, and they filter light wavelengths in a manner similar to the electronic RF filters. In fact the light wavelength at 1300 nanometers is a frequency of about 230,000 GHz, and thus most optical components are similar to RF components, i.e., modulators, couplers, attenuators, etc. The two beams are sent through separate electrical mixers 34, filters 35 and high power amplifiers 36 to minimize unwanted mixing products. Demodulated light at the two different wavelengths is processed by respective photodetectors 33, mixers 34, filters 35 and amplifiers 36 to produce amplified RF difference signals at the respective signal frequencies. These respective difference signals are then summed in a summing device 38 and coupled to the radiator 37.

Figure 3:
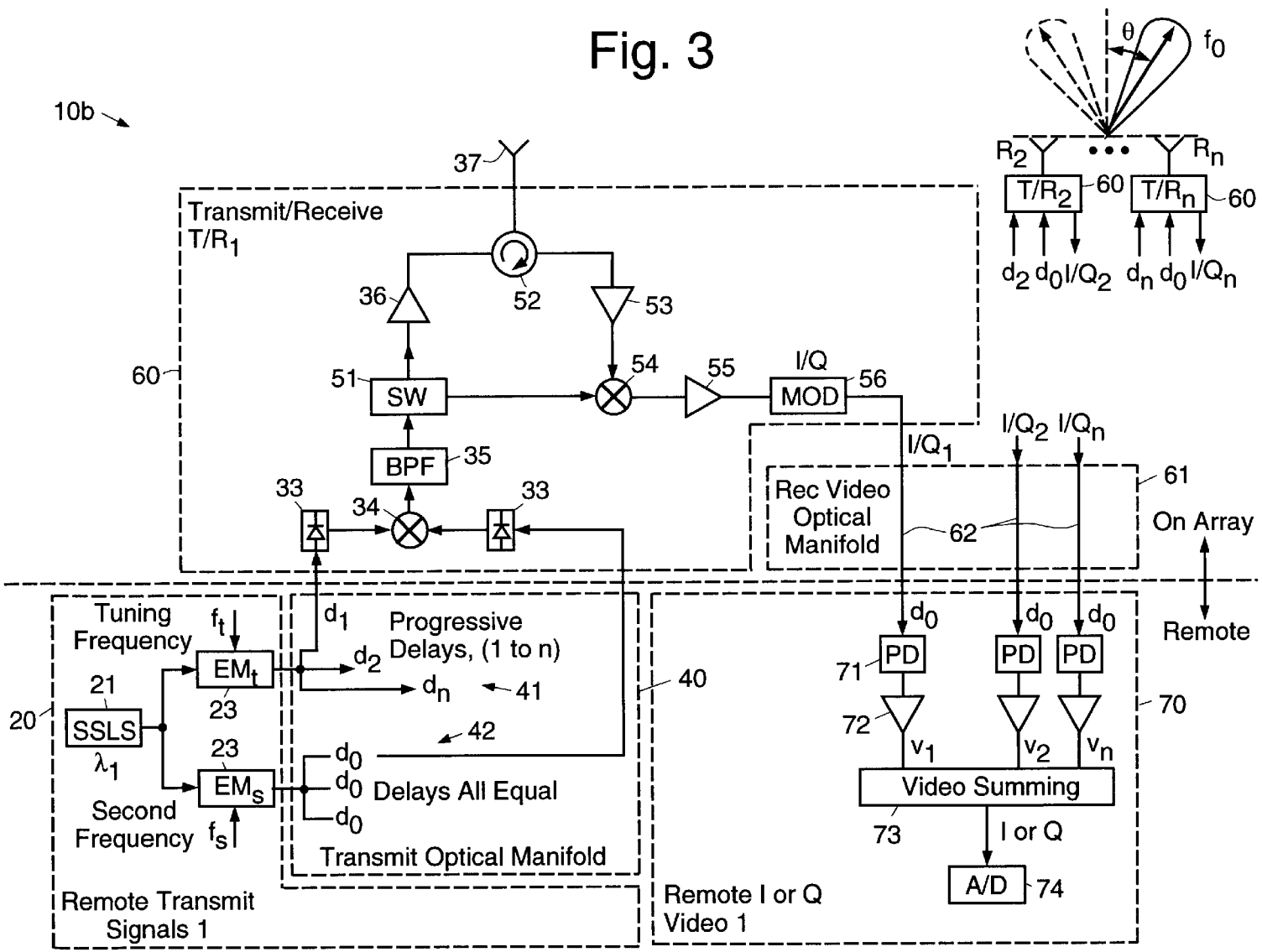
FIG. 3 shows a one dimensional active array radar system for combined transmission and reception in accordance with the principles of the present invention.

A receive function is provided by the present invention and may be achieved electronically as shown in FIG. 3 that shows both transmission and reception combined for one beam. More specifically, FIG. 3 shows a one dimensional active array 10*b* or active array radar system 10*b* in accordance with the principles of the present invention. The radar system 10*b* uses the modified corporate feed 40 with the received function achieved by using the same progressive phases that were generated for the transmit function for the local oscillator (LO) signal for mixers 54 at each radiator 37 that mix the receive signals to baseband video. Signals may also be mixed to some intermediate frequency (IF) using the same technique but with a different frequency for receive LO than the transmit frequency.

On receive, the transmit frequency is one input to receive mixers 54 by way of switches 51 (one for each beam beam/frequency) in each transmit/receive module 60. Incoming RF signals are routed for receive using a circulator 52, amplified in a low noise amplifier 53 and mixed in a mixer 54 to provide in-phase and quadrature (I/Q) video. The I/Q video is amplified in a video amplifier 55 and modulated on a light carrier by a modulator 56 (such as a directly modulated laser 56, for example) and coupled off the array 10*b* using an optical video manifold 61 to a remote I or Q video processor 70. The video processor 70 includes photodiode detectors 71 that demodulate the video. The video outputs from each radiator 37 are amplified 72 and summed 73 independently and digitized in separate I/Q analog-to-digital (A/D) converters 74, which provide outputs signals that may be displayed.

Thus, FIG. 3 shows a combined transmit and receive system 10*b* for a single beam. The transmit/receive module 60 (one for each radiator 37) implements a combined transmit and receive function for only one beam, although simultaneous multiple beams/frequencies may readily be implemented for transmission and reception in the manner similar to that shown for transmission in FIG. 2.

The received RF signal is mixed with the same frequency signal that is radiated (transmitted). Thus, the transmit frequency signal having the beamsteering relative phases (this is clarified in the next paragraph) is used as a local oscillator (LO) signal for the receive mixer 54. The receive mixer 54 is shown separate from the transmit mixer 34, but one mixer 34 may be time shared (via switching) for both functions. The LO signal requires correct phase to "steer" the received signal. All the received signals have the proper progressive phase to form the desired beam when added together.

Since mixing is used, in order to have the phases add correctly when they are summed, the conjugate or negative phase (the phase value formed by subtracting the transmit phase from 360 degrees) is used when the mixed difference frequency is desired. This is because the mixing produces the difference of the two signal inputs for the mixed difference frequency, and the relative phases of the two inputs to the receive mixer 54 are subtracted in the process. To provide the negative phases needed for the LO signals for the normal case when the difference frequency is desired, the phase that would be needed to steer the array to the angle that is symmetrical to the pointing angle about the antenna boresight (straight ahead direction) can be used. This is illustrated by the phantom beam (dashed lines) shown adjacent the transmit beam at $f_0$ shown FIG. 3. Thus, if the antenna was originally pointed to a +30° for transmission, the phase for receive is the phase needed for a −30° pointing angle. This provides the correct negative (conjugate) phase for mixing in receive so a received beam can be formed by adding all radiator input signals.

The pointing phase for the symmetrical angle to the transmission pointing angle can thus be generated by using the identical hardware configuration used for transmission. However, for receive, a pointing direction phase for the angle symmetrical to the transmit pointing angle can be generated for the LO signals. This is a simple way to obtain the needed LO signals. This technique may be used for baseband mixing or for mixing to an IF frequency since the phases generated are the same, since the tuning (steering) frequency is the one that establishes the progressive phases. Mixing to baseband or some IF will not cause the tuning frequency to change, only the signal frequency. Also, since the IF is typically much smaller than the transmit frequency, the same filter 35 can be used.

The receiver mixer 54 may be an in-phase (I) and quadrature (Q) mixer 54 to provide I and Q data, so that RF phase information is retained and signals can be remoted more easily. Thus, both I and Q signals only need amplitude to be preserved separately and they are added separately and then the total I and Q signals are added to obtain the desired received beam. Each I/Q baseband (video) received signals (only one is shown) are added to get one beam prior to the digitizing in the A/D converter 74. Each transmit/receive module 60 may use the directly modulated laser 56 as a modulator 56 to send the received I or Q signal (one laser for I and one for Q) to a remote area for further processing. Again, IF mixing may be used instead of I/Q mixing. The receive process can be replicated as implemented for transmission to receive multiple simultaneous beams and/or frequencies.

Now using FIG. 3 to trace the transmit and receive function the present invention will now be described. For transmission, a tuning (steering) frequency, $f_t$, is modulated on a light carrier and is sent through progressive delays 41 to each radiator 37 to generate the progressive phases to steer the array 10*b*. The second frequency is modulated on the same wavelength light carrier and sent through a true corporate feed 42 (equal lengths, delays) to each radiator 37. The second frequency is the sum of the tuning frequency and the signal (or frequency to be radiated and/or received) frequency. Thus, every time the tuning frequency is changed to steer the array 10*b* the second frequency is locked to and tracks that change. The two frequencies (tuning and second) are mixed at each radiator 37 to produce a difference frequency (after filtering) that is always the same radiated frequency independent of the tuning frequency that is used to point the array 10*b*.

The radiated (transmit) signal is then sent through the switch 51, the high power transmit amplifier 36 and the circulator 52 to the radiator 37. On receive the signal comes back through the circulator 52 to the low noise amplifier 53 and into the receive I/Q mixer 54. The transmit signal is adjusted for obtaining the conjugate phase and switched to become the LO to the mixer 54 to generate the steering phase for receive. The baseband, video, I/Q signal out of the mixer 54 is modulated onto light in the low frequency directly modulated laser 56, or modulator 56, and sent to the remote video processing circuits 70 via the video optical manifold 61. The baseband received signal is put onto an equal delay corporate feed 62 (that could be the same one that is used for the second frequency in transmission, via wavelength division multiplexing as shown in FIG. 2, for example). Again, IF mixing instead of baseband mixing may be used. Each (baseband and IF) have their advantages and the choice depends on the system design. Also, the sending of the I/Q signals can be accomplished optically or using electronics.

For two-dimensional (2-D) beamsteering, the use of different progressive delays 41 in azimuth (horizontal) and elevation (vertical) allow only one beam steering frequency to be user to steer both in azimuth and in elevation. This is opposed to a more conventional use of independent signal generating circuits, one for each elevation row in the two-dimensional array 10*b*. Different progressive delay lengths can be selected for any azimuth and elevation beam coverage. The progressive delays ($d_1$-$d_n$) for beam steering are all multiples of a basic delay length ($d_1$) in the modified corporate feed 41, as shown in FIG. 3. A second basic delay length ($d_x$) which is much larger than $d_1$ and thus causing larger changes in phase can be chosen for the other beam dimension in a two dimensional array (azimuth, one dimension, and elevation, the other dimension). This single frequency technique produces a full coverage scanning and uses the same beamsteering tuning frequency for both azimuth and elevation. The steering using this technique causes the beam in one dimension (say elevation) to go through its entire beam scan range while the beam in the other dimension (azimuth in this case) moves through less than one beamwidth. This occurs because the elevation phase change is much greater than the azimuth phase change for a given change in steering frequency. This single frequency steering technique generates a full coverage beam scanning in a manner similar to television raster scanning in the horizontal and vertical dimensions.

The addition of either optoelectronic and/or electronic techniques for phase and gain adjustments at each radiator 37 for each frequency and/or beam allows the phase and gain to be calibrated when required to compensate for electronic component phase and gain errors over frequency. These changes are typically applied slowly, so these devices do not need very fast response. This is needed because the phase values needed for calibration cannot be obtained from the beamsteering process.

The use of a tuning frequency range that has its center frequency of tuning at a guide wavelength, a multiple of which is the separation between radiators 37 of the array 10*b*, allows steering to broadside. This will cause the phase between each element to change by some multiple of 360 degrees ($2\pi$) and thus produce the same relative phase at each radiator 37. This cannot be accomplished electronically with a conventional series delay line traveling wave feed whereas it is easily achieved using the present modified corporate feed 41.

True time delay (TTD) beamsteering can be combined with this type of phase beamsteering by combining the two techniques. The TTD can be used to steer the entire subarrays 10 of the antenna with the phase steering of the present invention used to steer the radiators 37 in each subarray 10.

Thus, active array systems that process simultaneous multiple beams/frequencies over a wide frequency operating range and thus overcome the limitations of conventional phased array systems has been disclosed. It is to be understood that the described embodiment is merely illustrative of some of the many specific embodiments which represent applications of the principles of the present invention. Clearly, numerous and varied other arrangements may be readily devised by those skilled in the art without departing from the scope of the invention.

What is claimed is:

1. Radar apparatus comprising:

an RF modulated light source for providing modulated light output signals at a first frequency, and at a second frequency that is equal to the first frequency plus a second frequency;

first and second optical splitters for respectively directing the modulated light output signals at the first and second frequencies along a respective plurality of light paths;

an optical manifold coupled to the first and second optical splitters for coupling the modulated light output signals at the first and second frequencies along a respective plurality of optical paths;

a plurality of photodetectors coupled to selected optical paths of the optical manifold for converting the modulated light output signals at the first and second frequencies into modulated electrical signals;

a plurality of mixers respectively coupled to the plurality of photodetectors for mixing the modulated electrical signals at the first and second frequencies;

a plurality of filters respectively coupled to the plurality of mixers for outputting difference signals corresponding to the difference between the first and second frequencies;

a plurality of amplifiers respectively coupled to the plurality of filters for amplifying the difference signals; and a plurality of radiators respectively coupled to the plurality of amplifiers for radiating the difference signals.

2. The apparatus of claim 1 wherein the optical manifold comprises a first plurality of light paths having progressive phase delays ($d_1$-$d_n$) for light at the first frequency and a second plurality of light paths 30 having substantially equal phase delays ($d_0$) for light at the second frequency, and wherein the plurality of photodetectors are coupled to corresponding ones of the first and second light paths of the optical manifold.

3. The apparatus of claim 1 wherein the RF modulated light source provides modulated light output signals at a plurality of first frequencies and at a plurality of second frequencies;

and wherein the apparatus further comprises:

wavelength division multiplexing means coupled to the optical manifold for multiplexing the pluralities of first and second frequencies for transmission through the optical manifold and for demultiplexing the pluralities of first and second frequencies for detection by the plurality of photodetectors; and summing means for combining difference signals at the respective first and second frequencies and coupling the difference signals to respective ones of the radiators.

4. The apparatus of claim 1 further comprising:

a plurality of switches coupled to the plurality of filters;

a plurality of circulators coupled between respective ones of the plurality of amplifiers and the plurality of radiators;

a plurality of receive mixers coupled to respective ones of the plurality of switches for processing difference signals derived from respective ones of the plurality of filters and signals received by respective ones of the plurality of radiators and for outputting a plurality of video signals; and video processing circuitry coupled to the plurality of receive mixers for providing output signals for display.

5. The apparatus of claim 4 wherein the difference signals applied to the receive mixers derived from the plurality of filters have a phase that is the conjugate of the transmit phase.

6. The apparatus of claim 1 wherein the tuning frequency center frequency is selected to produce a modulo $2\pi$ progressive phase change at the inputs to all radiators to provide for broadside boresight steering.

7. The apparatus of claim 1 wherein a single tuning frequency is used to steer a two dimensional array.

8. The apparatus of claim 7 wherein progressive delays for one dimension are selected to be much larger than for an orthogonal dimension.

9. The apparatus of claim 1 wherein the RF modulated light source provides a plurality of modulated light output signals at a different frequencies, and at a plurality of second frequencies that are equal to the respective first frequencies plus a second frequency, and wherein multiple beams/frequencies are provided by coupling the plurality of modulated light output signals to the optical manifold for transmission and reception.

* * * * *